United States Patent [19]

Peterson

[11] Patent Number: 4,500,146

[45] Date of Patent: Feb. 19, 1985

[54] LOCKER SHELF ASSEMBLY

[75] Inventor: Richard R. Peterson, Minnetonka, Minn.

[73] Assignee: Sioux Technology, Inc., Minnetonka, Minn.

[21] Appl. No.: 519,038

[22] Filed: Aug. 1, 1983

[51] Int. Cl.[3] ..... A47F 5/00

[52] U.S. Cl. ..... 312/257 SM; 108/102; 108/107; 108/27; 211/187; 211/175

[58] Field of Search ..... 108/27, 102, 107, 110; 211/135, 153, 201, 175, 187; 312/293, 257 SK, 257 SM, 257 R

[56] References Cited

U.S. PATENT DOCUMENTS

| | | | |
|---|---|---|---|
| D. 141,386 | 5/1945 | Rosenfeld | 108/27 |
| 332,238 | 12/1885 | Denton . | |
| 739,085 | 9/1903 | Kamerer . | |
| 940,023 | 11/1909 | Hutchinson | 108/107 |
| 1,167,550 | 1/1916 | Forsyth . | |
| 1,602,410 | 10/1926 | Hamblin . | |
| 1,895,535 | 1/1933 | Brecht . | |
| 2,346,430 | 4/1944 | Hauser | 312/393 |
| 2,360,452 | 10/1944 | Stone | 312/293 |
| 2,441,721 | 5/1948 | Schroeder | 108/102 |
| 2,546,851 | 3/1951 | Conrad . | |
| 2,791,336 | 5/1957 | Stairwalt . | |
| 3,082,711 | 3/1963 | Vetere | 108/107 |
| 3,360,321 | 12/1967 | Novales . | |
| 3,916,802 | 11/1975 | Virtue et al. | 108/102 |
| 3,993,002 | 11/1976 | Stroh | 108/112 |
| 4,118,087 | 10/1978 | Dorf . | |
| 4,155,312 | 5/1979 | Thorkildson | 108/102 |

*Primary Examiner*—William E. Lyddane
*Assistant Examiner*—Joseph Falk
*Attorney, Agent, or Firm*—Burd, Bartz & Gutenkauf

[57] ABSTRACT

A shelf assembly for a storage locker having a plurality of upright rails locatable in the corners of the locker. A plurality of generally horizontal shelves are releasably mounted on the rails. Each shelf has first and second shelf members having cooperating guides which allow lateral expansion of the shelves to permit the shelf assembly to be used with different sized lockers. A releasable fastener holds the shelf members in their adjusted positions.

16 Claims, 10 Drawing Figures

LOCKER SHELF ASSEMBLY

FIELD OF INVENTION

The technical field of the invention is shelf structures for use in cabinets and closets to support objects. Specifically, the invention is directed to a shelf assembly for use with a clothing storage locker.

BACKGROUND OF INVENTION

Cabinets having horizontal shelves for storing household items and clothing have been used in homes, schools, and gyms, and industrial factories for many years. Denton, in U.S. Pat. No. 332,238, discloses a cabinet accommodating a frame having a plurality of shelves for carrying boots and shoes. The shelves have fixed lengths and fit inside a specific cabinet size. There is no provision or need to alter the size or the shape of the shelves.

Industrial, commercial, military, and educational institutions use storage lockers for the temporary storage of personal items, such as clothing and books. An example of a knock-down locker is shown by Novales in U.S. Pat. No. 3,360,321. These lockers have a top shelf permanently attached to the locker side walls. The shelf has a fixed length and fits into a specific size locker. Additional locker shelves have been improvised with boards and plywood panels. The panels are made slightly wider than the width of the locker so they can be wedged against the locker side walls to hold them at a selected vertical position. The wedging of the panels against the side walls distorts and bends the locker walls and door frame. In some cases, the door frame is warped so that the door cannot be closed. Lockers are located in side-by-side or row positions. When one locker is distorted, the adjacent locker is also distorted. This can cause the doors to jam shut or prevent the doors from closing. The locker shelf assembly of this invention, when used with a conventional locker, does not distort or bend the locker walls and door frame.

SUMMARY OF INVENTION

The invention resides in a shelf assembly for use with a locker having an interior chamber for storing articles, such as clothing, books, tools, and the like. The locker is a conventional locker used in homes, schools, gymnasiums, and industrial and office environments. These types of lockers have side walls, back walls, bottom and top walls, and a door frame supporting a door. The shelf assembly is an independent shelf unit that fits into varying sizes of lockers. It can be erected in the locker chamber without the use of tools with a minimum of time and labor. The shelf assembly provides one or more vertically locatable shelves that can be used as additional storage and organizing space within the locker chamber.

The shelf assembly has a plurality of upright rails providing supports for one or more generally horizontal shelves. The rails and shelves have cooperating means for releasably mounting the shelves on the rails in a selected position. Each shelf has a first shelf member and a second shelf member. The first and second shelf members have means for guiding the shelf members for lateral movement relative to each other, so that the shelf members can be moved to a contracted position and an expanded position. When the shelf members are laterally moved to the expanded position, the rails are located adjacent the side walls of the locker. A holding means mounted on the shelf members is operative to retain the shelf members in the expanded position and thereby retain the shelf assembly within the locker.

In one embodiment of the apparatus, four upright rails are located in the corners of the locker chamber. Each of the rails has a plurality of vertically spaced slots. Each shelf has hook-like connector means adapted to be located through at least one slot in each rail to support the shelf on the rail. The guide means for the first and second shelf members includes a first flange on opposite sides of the first shelf member and a horizontal second flange on opposite sides of the second shelf member. The first flange has inwardly directed tabs that cooperate with the second flange on the second shelf member for horizontally guiding the shelf members. Each shelf member has end sections that are engageable with a pair of rails. A plurality of hook-like connectors on each end section holds the end section in engagement with a rail and provides the shelf with horizontal stability and the rail with vertical stability.

The holding means for retaining the first and second shelf members in an expanded position comprises a horizontal slot in one of the shelf members and a releasable fastening means mounted on the other shelf member and extended through the slot. The releasable fastening means functions to secure the first and second members together.

Each of the shelf members comprises a generally flat plate having opposite side edges integral with generally longitudinal side flanges. The opposite portions of each plate have notches to accommodate the upright rails. An upwardly directed lip is joined to the ends of each plate and extends between the notches. The lip is located in close proximity to the locker side wall.

DESCRIPTION OF PREFERRED EMBODIMENT

Figure 1:
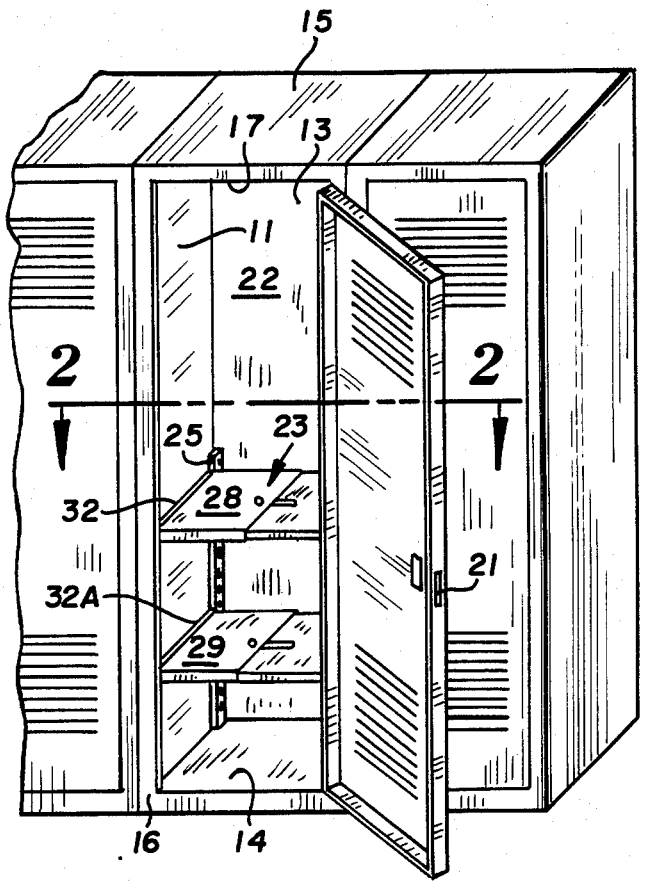
FIG. 1 is a perspective view of a group of lockers showing one of the lockers accommodating the locker shelf assembly of the invention.
Figure 2:
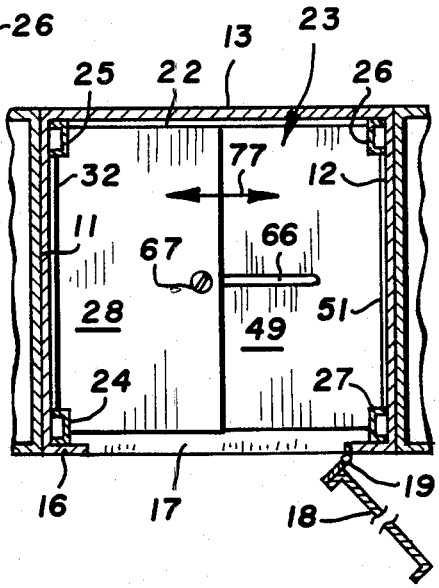
FIG. 2 is an enlarged sectional view taken along the line 2—2 of FIG. 1.

Referring to FIGS. 1 and 2, there is shown a conventional locker indicated generally at 10. Locker 10 is an enclosure used by one or more persons for safekeeping of clothing, books, tools, and like articles. Locker 10 has an upright housing having upright side walls 11 and 12 joined to an upright back wall 13. The lower portion of the housing has a bottom wall 14. The top of the housing is closed with a top wall 15. A door frame 16 surrounds the front of the housing and provides a generally rectangular doorway 17. A door 18 secured to one side of door frame 16 with a plurality of hinges 19 is operable to move from an open position to a closed position. As shown in FIGS. 1 and 2, door 18 is in the open position. The door has a latch or releasable lock 21 operable to hold door 18 in a closed position. The housing has a chamber 22 for storing articles, such as clothing, books, and the like. Lockers of the type shown in FIG. 1 are used in schools, gymnasiums, athletic locker rooms, offices, shops, public places, and the like for storing all types of articles.

The locker shelf assembly indicated generally at 23 of the invention is located in chamber 22. Locker shelf assembly 22 has a plurality of shelves or platforms 28 and 29 in the lower portion of chamber 22 for supporting articles. Two shelves 28 and 29 are shown in FIG. 1. Locker shelf assembly 23 can have more than two shelves, or a single shelf. A plurality of upright legs 24, 25, 26, and 27 adapted to be located in each of the corners of the housing chamber 22 support the shelves 28 and 29. The legs 24–27 may be viewed as upright corner posts supporting upper shelf 28 and a lower shelf 29 in generally horizontal positions. The upper and lower shelf units 28 and 29 are identical in construction. The following description is directed to upper shelf 28. The corresponding parts of lower shelf 29 are identified with the same reference numerals having the suffix A.

Referring to FIGS. 4–9, upper shelf 28 has a first shelf member or plate 31 having an outside upwardly directed continuous lip 32. Lip 32 extends between notches 33 and 34 located in the outer corners of plate 31. Notches 33 and 34 accommodate portions of the upright legs and allow lip 32 to be located adjacent an inside wall of locker 10. The opposite sides of plate 31 have downwardly directed continuous flanges 36 and 37. Flange 36 has a plurality of inwardly directed tabs or ears 38. Flange 37 has a plurality of inwardly directed tabs or ears 39. Ears 38 and 39 are located below plate 31 and are directed toward each other thereby forming supports. Flange 36 has a downwardly directed end section 41 having a plurality of male connectors 42 and 43 adapted to be connected to a rail. Connectors 42 and 43 are flat hooks or fins that are releasably connected to rail 24. Connector 42 has an upwardly directed slot 44 adapted to receive a flat portion of rail 24. Connector 43 has an upwardly directed slot 46 adapted to receive a second flat portion of rail 24. Flange 37 has a downwardly directed end section provided with a pair of male connectors 48. The end section and male connectors 48 are identical to the end section 41 and male connectors 42 and 43. Each of the male connectors 42, 43, and 48 have upwardly directed slots 44 and 46 to accommodate flat portions of a rail. When male connectors 42, 43, and 48 are hooked onto the rails, slots 44 and 46 accommodate separate flat portions of the rails. The edges of the end sections between connectors 42, 43, and 48 and adjacent opposite sides of the connectors are held in engagement with the rails. This vertically stabilizes the rails and horizontally stabilizes the shelf.

Figure 7:
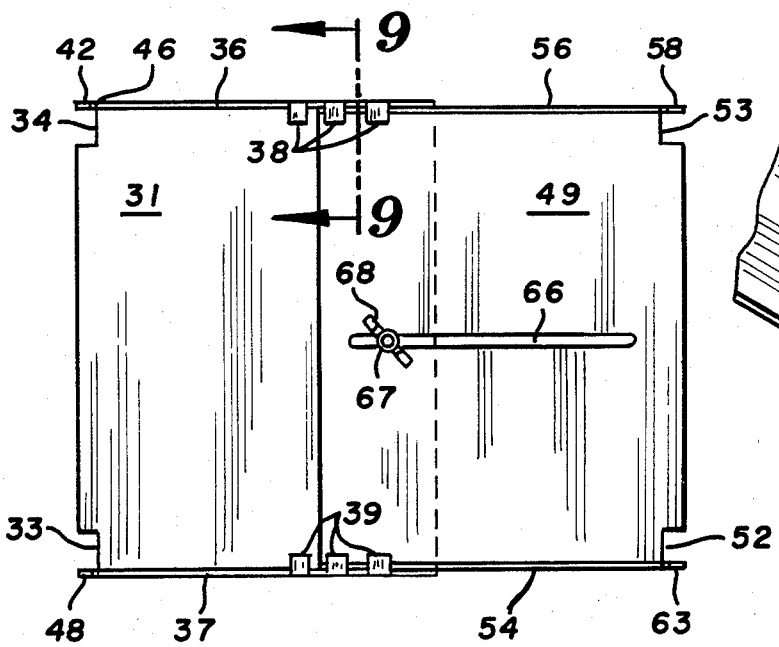
FIG. 7 is a bottom view of the shelf of FIG. 4.

Shelf 28 has a second shelf member or plate 49 having an upwardly directed lip 51. Lip 51 extends between corner notches 52 and 53. Notches 52 and 53 accommodate portions of the corner rails and allow lip 51 to be located adjacent an inside wall of locker 10. Second plate 49 has a pair of downwardly directed side flanges 54 and 56 extended generally parallel to flanges 36 and 37 of plate 31. As shown in FIG. 7, flanges 54 and 56 telescope within flanges 36 and 37 and are supported on the inwardly directed tabs 38 and 39. Flanges 36 and 37 and tabs 38 and 39 provide guides for flanges 54 and 56 to allow lateral adjustment of plates 31 and 49 relative to each other. Plates 31 and 49 are laterally adjusted to change the overall width of shelf 28. This allows shelf assembly 23 to be used with different size lockers. For example, shelf assembly 23 can fit in lockers that vary in width between 8 to 12 inches or 20 to 30 cm.

Figure 5:
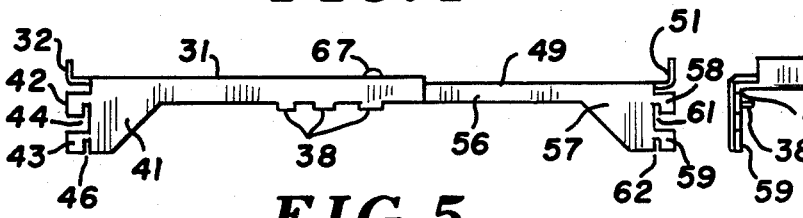
FIG. 5 is a front view of the shelf of FIG. 4.
Figure 6:
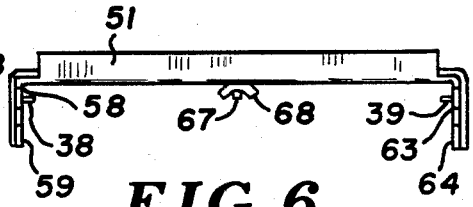
FIG. 6 is a side view of the shelf of FIG. 4.

As shown in FIG. 5, flange 56 has a downwardly directed end section 57 having a pair of male connectors 58 and 59. Male connector 58 has an upwardly directed slot 61 to accommodate a flat portion of the rail. Male connector 59 has a slot 62 to accommodate a second flat portion of the same rail. Flange 54 has a pair of male connectors 63 and 64, shown in FIG. 6, adapted to be releasably connected to an upright rail. Male connectors 63 and 64 each have upwardly directed slots (not shown) similar to slots 61 and 62, as shown in FIG. 5.

Figure 4:
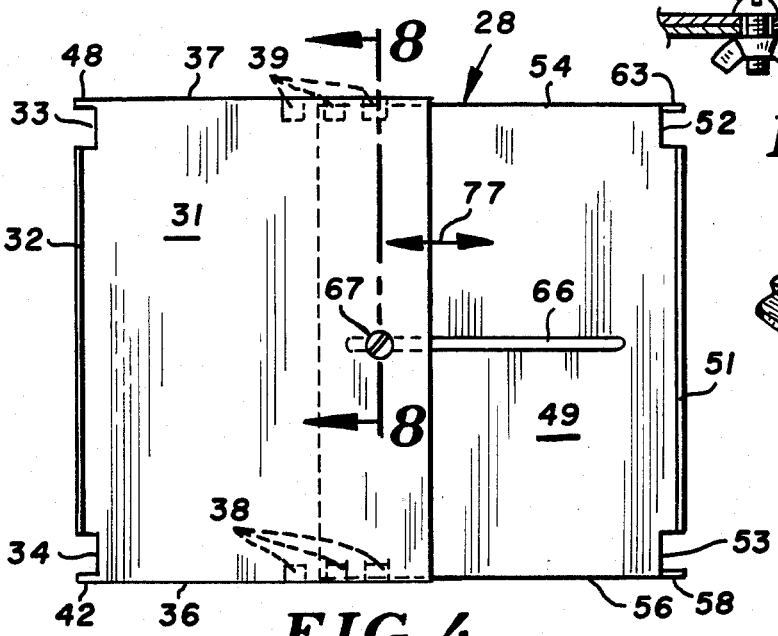
FIG. 4 is a top view of a shelf of the locker shelf assembly.
Figure 8:
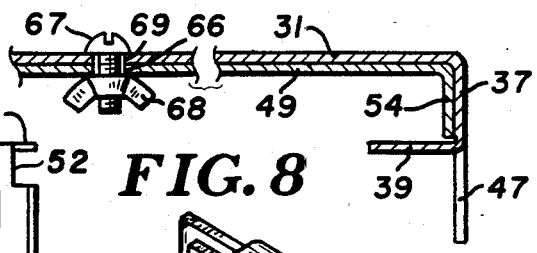
FIG. 8 is an enlarged foreshortened sectional view taken along the line 8—8 of FIG. 4.
Figure 9:
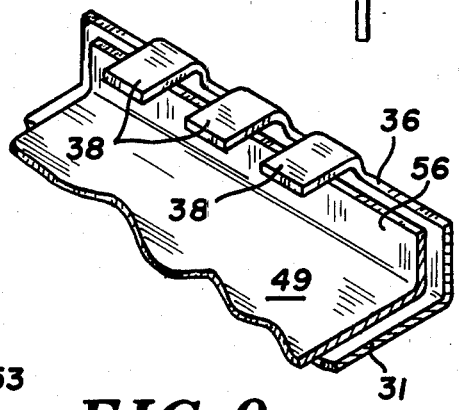
FIG. 9 is an enlarged sectional view taken along the line 9—9 of FIG. 7.

Referring to FIGS. 4 and 7, second plate 49 has a transverse centrally located slot 66. Slot 66 extends generally parallel to flanges 54 and 56. As shown in FIG. 8, a releasable fastener 67 comprising a threaded bolt accommodating a wing nut 68, extends through a hole 69 in plate 31 and slot 66. The function of releasable fastener 67 is to clamp plates 31 and 49 together in an adjusted lateral position.

Figure 10:
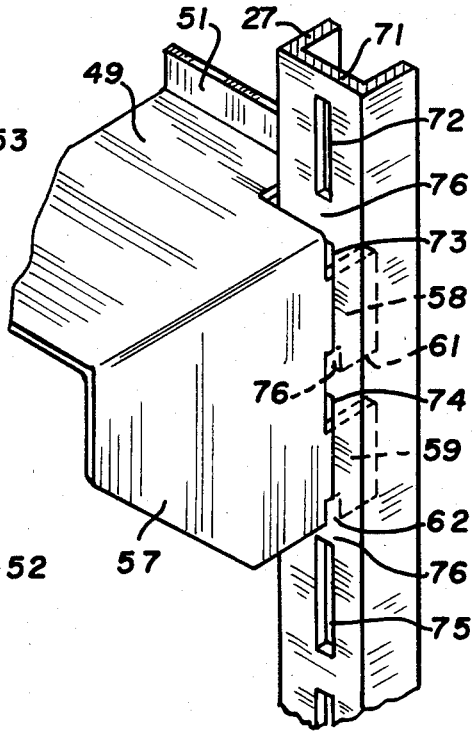
FIG. 10 is an enlarged corner of the shelf assembled and mounted on a rail.

Referring to FIG. 10, rail 27 is a channel or U-shaped member having a flat base 71. Base 71 is provided with a plurality of vertically spaced holes or slots 72, 73, 74, and 75. The entire length of base 71 can be provided with vertically spaced slots to allow selected vertical location of shelves 28 and 29. Base 71 has flat connecting sections 76 between adjacent slots. Sections 76 are tongues that fit into the grooves 61 and 62 when shelf 28 is assembled on rail 27. Slots 72–75 have a vertical height slightly larger than the vertical height of male connectors 58 and 59 to allow each male connector to be moved through female slots 73 and 74. When male connectors 58 and 59 have moved all the way into slots 73 and 74, plate 49 is moved down to locate rail sections 76 in upright grooves 61 and 62. Slots 72–75 are shown as upright rectangular openings accommodating generally flat projections forming the male connectors. Slots 72–75 can have other shapes, such as keyhole slots, which accommodate undercut projections extended from the end section 57. Each of the rails 24, 25, 26, and 27 have slots along the length of the base thereof similar to slots 72–75, as shown in FIG. 10. Each rail can be provided with vertically spaced projections or tabs which fit into holes or slots in the ends of each of the side flanges 26, 27, 54, and 56.

Figure 3:
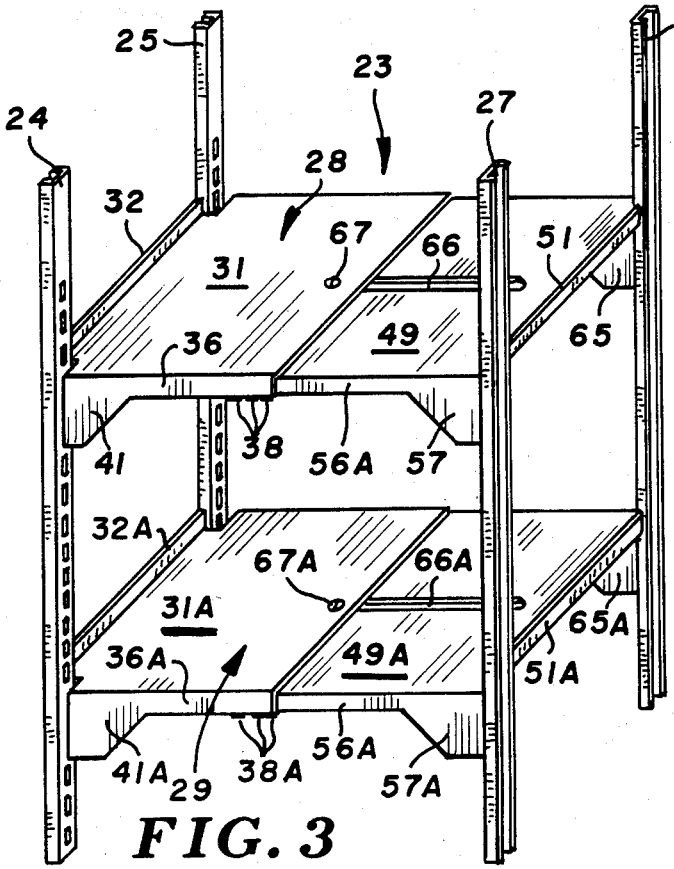
FIG. 3 is a perspective view of the locker shelf assembly of the invention.

In use, shelf assembly 23 is assembled as shown in FIG. 3. Plate 49 is slidably supported on plate 31. Flanges 54 and 56 are supported on tabs 38 and 39 and laterally guided by flanges 36 and 37. Fastener 67 is released by loosening wing nut 68. The upper and lower shelves 28 and 29 are moved together or to a collapsed narrow position. Male connectors 42, 43, 48, 58, 59, and 63 are inserted through selected slots in the rails 24–27 to locate the shelves in the desired positions. The shelves are moved in a downward direction to locate the rail base portions in the slots. This vertically locates rails 24–27 and horizontally locates the shelves 28 and 29. The collapsed shelf assembly 23 is then moved through doorway 17 into locker chamber 22. When shelf assembly 23 is in locker chamber 22, the shelves 28 and 29 are manually expanded until rails 24, 25, 26, and 27 are located adjacent the opposite locker side walls 11 and 12 in the corners of locker chamber 22, as shown in FIG. 2. Fasteners 67 and 67A are then tightened with wing nuts to clamp the first and second plates 31, 49 and 31A, 49A together. This retains the upright rails 24, 25, 26, and 27 in the corners of the locker chamber 22. The shelf assembly 23 can be erected and placed into the locker without the use of tools.

Shelf assembly 23 does not place destructive outwardly directed forces on locker side walls 11 and 12, nor back wall 13. The entire shelf assembly 23 is standing on the bottom of the locker. Door frame 16, being in front of posts 24 and 27, prevents shelf assembly 23 from moving outwardly through doorway 17 when door 18 is open. Upright lips 32 and 51 are located adjacent side walls 11 and 12, respectively. They function as upright ledges to prevent small objects, such as pencils and tools, from falling to the bottom of the locker chamber.

The upper and lower shelf units 28 and 29 can be covered with paper, cardboard, shelf paper, or carpeting to provide cushioning and ornamental appearance to shelf assembly 23.

While there has been shown and described the preferred embodiment of the shelf assembly of the invention in association with a conventional locker, it is understood that changes in the shelf assembly may be made by those skilled in the art without departing from the invention. For example, the length of the rails can vary. Also, the number of shelves can be changed without departing from the invention. The invention is defined in the following claims.

The embodiments of the invention in which an exclusive property or privilege are claimed are defined as follows:

1. A shelf assembly for a locker having opposite side walls, a back wall joined to the side walls, a bottom wall, and a front door frame having a doorway, said door frame being joined to the side walls, providing access to the interior chamber of the locker defined by said walls, said chamber having corners, comprising: a plurality of upright rails locatable in said chamber adjacent the side walls, each of said rails having a plurality of vertically spaced slots, a plurality of generally horizontal shelves located in said chamber, each shelf having a first shelf member and a second shelf member, said first shelf member having a generally flat horizontal first plate having opposite sides, downwardly directed first flanges joined to the opposite sides, and a plurality of inwardly directed tabs joined to said first flanges, said second shelf member having a generally flat horizontal second plate having opposite sides, and downwardly directed second flanges join to the opposite sides of the second plate, said first and second plate having surface portions engageable with each other, said second flanges having portions thereof being located adjacent the inside of the first flanges between the tabs and first plate for guiding the shelf members for lateral movement relative to each other, said shelf members being laterally movable relative to each other to expand the shelf and locate the rails adjacent said side walls, each of said first and second flanges having a downwardly directed end section engageable with a rail and downwardly open hook means joined to the end section, said hook means extended through at least one slot in the rail to support the shelf member on the rail, and means for holding the first and second shelf members in an expanded position to thereby locate the shelf assembly in the locker chamber with the rails positioned adjacent the side walls of the locker, said means for holding the first and second shelf members in an expanded position includes a linear slot in one of the plates extended generally parallel to said first and second flanges, and a releasable fastening means mounted on the other plate and extended through said slot operable to hold the surface portions of the first and second plates in engagement with each other thereby clamping the first and second plates together and hold the rails adjacent said side walls.

2. The shelf assembly of claim 1 wherein: each of said shelves has an upwardly directed lip extended between a pair of rails.

3. The shelf assembly of claim 1 wherein: each of said first and second plates has a notch in opposite sides thereof adjacent the end sections for accommodating a rail.

4. The shelf assembly of claim 1 wherein: said hook means comprises a plurality of downwardly directed hooks located adjacent opposite sides of each shelf member, said hooks extended through slots in the rails.

5. The shelf assembly of claim 1 wherein: the plurality of upright rails comprise four rails, each rail being adapted to be located in a corner of the chamber of the locker.

6. The shelf assembly of claim 1 wherein: each of the first and second plates has a notch in opposite sides thereof for accommodating a rail, and an upwardly directed lip extended between said notches.

7. A portable and removable shelf assembly for a locker having opposite first and second side walls, a back wall joined to the side walls, a bottom wall, and a front door frame having a doorway, said door frame being joined to the side walls providing access to the interior of the chamber of the locker defined by said walls, said chamber having corners comprising: a plurality of upright first rails located adjacent the first side wall, a plurality of upright second rails adapted to be located adjacent the second side wall, said first and second rails being unattached to said side walls to allow removal of the rails from the locker chamber, shelf means for supporting articles, said rails and shelf means having cooperating means for releasably mounting the shelf means on the rails in a selected position, said shelf means having a first shelf member and a second shelf member, means on said first and second shelf members for guiding the shelf members for lateral movement relative to each other, said shelf members being laterally movable relative to each other to expand the shelf means and locate the first rails adjacent said first side wall and locate the second rails adjacent said second side wall, and means for holding the shelf members in an expanded position to thereby locate the shelf assembly in the locker chamber with the first and second rails positioned adjacent the first and second side walls of the locker.

8. The shelf assembly of claim 7 wherein: each of said shelf members comprises a generally flat plate having opposite side edges, said plate having notches adjacent said side edges, and an upwardly directed lip extended between said notches.

9. The shelf assembly of claim 7 wherein: said means on said first and second shelf members for guiding the shelf members includes a first flange on opposite sides of the first shelf member and a second flange on opposite sides of the shelf member adjacent the inside of the first flange, and inwardly directed tab means on each first flange, said tab means and first flanges cooperating with said second flanges for horizontally guiding the first and second shelf members whereby the shelf members can be moved to a contracted position and an expanded position.

10. The shelf assembly of claim 9 wherein: said means for holding the first and second shelf members in an adjusted position includes a linear slot in one of the shelf members, extended generally parallel to the flange on said one shelf member and releasable fasteners mounted on the other shelf member and extended through said slot to clamp the first and second shelf members together.

11. The shelf assembly of claim 7 wherein: said cooperating means for releasably mounting the shelf means on the rails comprises hook and slot connecting means attaching the first shelf member to said first rails and the second shelf member to said second rails.

12. A shelf assembly for a locker having opposite side walls, a back wall joined to the side walls, a bottom wall, and a front door frame having a doorway, said door frame being joined to the side walls and providing access to the interior chamber of the locker defined by said walls, said chamber having corners, comprising: a plurality of upright rails locatable in said chamber adjacent the side walls, each of said rails having a plurality of vertically spaced slots, a plurality of generally horizontal shelves located in said chamber, each shelf having end sections engageable with a rail and a plurality of flat hooks secured to and extended from the end sections, each of said hooks extended through a slot in the rail and engageable with a portion of the rail to releasably mount the shelves on the rails, each shelf having a first shelf member and a second shelf member, guide means on said first and second shelf members for guiding the shelf members relative to each other, said guide means including a first flange on opposite sides of the first shelf member and a second flange on opposite sides of the second shelf member located adjacent the inside of the first flange, and inwardly directed tab means on each first flange, said tab means and first flanges cooperating with said second flanges for horizontally guiding the first and second shelf members for lateral movement relative to each other to expand the shelf and locate the rails adjacent said side walls, and means for holding said first and second shelf members in a selected expanded position to thereby locate the shelf assembly in the locker chamber with the rails positioned adjacent the side walls of the locker.

13. The shelf assembly of claim 12 wherein: each of said first and second shelf members has an upwardly directed lip extended between a pair of rails.

14. The shelf assembly of claim 12 wherein: each of said shelf members includes a generally flat plate, each plate having a pair of notches in opposite sides thereof for accommodating a rail.

15. The shelf assembly of claim 14 including: a generally upwardly directed lip means on each of said plates, said lip means extended between a pair of notches.

16. The shelf assembly of claim 12 wherein: said means for holding the first and second shelf members in an adjusted position includes a linear slot in one of the shelf members extended generally parallel to flanges on said one shelf member, and a releasable fastening means mounted on the other shelf member and extended through said slot to clamp the first and second shelf members together.

* * * * *